US005144274A

United States Patent [19]

Masaki

[11] Patent Number: 5,144,274

[45] Date of Patent: Sep. 1, 1992

[54] SEALED VARIABLE RESISTOR

[75] Inventor: Kazumi Masaki, Osaka, Japan

[73] Assignee: Ken Hayashibara, Okayama, Japan

[21] Appl. No.: 618,795

[22] Filed: Nov. 28, 1990

[30] Foreign Application Priority Data

Nov. 28, 1989 [JP] Japan ..... 1-137428[U]

[51] Int. Cl.[5] ..... H01C 10/14; H01C 10/32

[52] U.S. Cl. ..... 338/12; 338/162; 338/172

[58] Field of Search ..... 338/164, 12, 189, 172, 338/116, 103, 104, 105, 106; 128/421, 422; 335/137

[56] References Cited

U.S. PATENT DOCUMENTS 3,569,894 3/1971 Bolduc et al. ..... 338/12

4,960,125 10/1990 Masaki ..... 128/421

*Primary Examiner*—Marvin M. Lateef

*Attorney, Agent, or Firm*—Browdy and Neimark

[57] ABSTRACT

The disclosure relates to an improvement of a sealed variable resistor including a variable resistor and an arm member attached to a shaft of the variable resistor enclosed in a sealing container, and rotatably supporting a dial knob about a shaft outside the sealing container such that when the dial knob is energized, the arm member moves in association by virtue of magnetic force. The reliability and operability of such a sealed variable resistor are extremely improved by forming the arm member and dial knob into a circular plate, and attaching to the arm member and dial knob at least two magnet pairs apart from each other. These render the sealed variable resistor very useful in various electrical devices which may be exposed to moisture when in use.

3 Claims, 3 Drawing Sheets

SEALED VARIABLE RESISTOR

BACKGROUND OF THE INVENTION

1. Field of the invention

This invention relates to a sealed variable resistor, in particular, to that which is favorably usable in humid surroundings such as in bathroom and bathtub.

2. Description of the prior art

In electrotherapeutic devices directed to use in such a humid surrounding, it is the most important issue to assure water- and moistureproofings for variable resistors as output controller and power switches in the devices. Although perfect water- and moistureproofings are easily attainable for oscillators and batteries by only enclosing them in a waterproofed sealing container, it is very difficult to perfectly waterproof certain elements with movable parts such as variable resistor and power switch.

I earnestly studied various means which might solve this issue of prior art. As the result, I eventually devised a sealed variable resistor comprising enclosing a variable resistor and an arm member attached to a shaft of the variable resistor in a sealing container, and rotatably supporting a dial knob about a shaft outside the sealing container such that when said dial knob is energized, said arm member moves in association by virtue of magnetic force, as well as disclosing the sealed variable resistor in Japanese Utility Model Kokai No. 40,953/88.

This sealed variable resistor however has the disadvantage that it is low in reliability because a decreased adhesive strength between the arm member and dial knob results in undesirable slippage and backlash, as well as having the advantage that it easily realizes prescribed water- and moistureproofings and also a smooth operation. An attempt to improve the adhesive strength using stronger magnets however has proved insuccessful because this tends to cause a contrary effect, i.e. damaging the balance between the arm member and dial knob and leading to a low operability of the dial knob.

SUMMARY OF THE INVENTION

One object of this invention is to provide a sealed variable resistor which is free from the disadvantage of prior art and attains a superiorly high reliability, operability and impact resistance even when relatively weak or small magnets are used. I particularly studied the shape of arm members and dial knobs, as well as studying the arrangement of magnets.

As the result, in a sealed variable resistor which comprises enclosing a variable resistor and an arm member attached to a shaft of the variable resistor in a sealing container, and rotatably supporting a dial knob about a shaft outside the sealing container such that when the dial knob is energized, the arm member moves in association by virtue of magnetic force, I discovered that the object is attainable by forming the arm member and dial knob into a circular plate, and attaching to the arm member and dial knob at least two magnet pairs apart from each other.

In particular, this invention relates to a sealed variable resistor which comprises enclosing a variable resistor and an arm member attached to a shaft of the variable resistor in a sealing container, and rotatably supporting a dial knob about a shaft outside the sealing container such that when the dial knob is energized, the arm member moves in association by virtue of magnetic force, characterized by forming the arm member and dial knob into a circular plate, and attaching to the arm member and dial knob at least two magnet pairs apart from each other.

Since in this invention, an arm member and a dial knob are formed into a circular plate and at least two magnet pairs are attached thereto, the arm member and dial knob strongly adhere each other even when relatively weak or small magnets are used.

Furthermore, since at least two magnet pairs are attached apart from each other, one can operate the dial knob with a relatively small power.

DESCRIPTION OF PREFERRED EMBODIMENTS

This invention is more fully understood from the following description taken in connection with the accompanying drawings in which.

Figure 1:
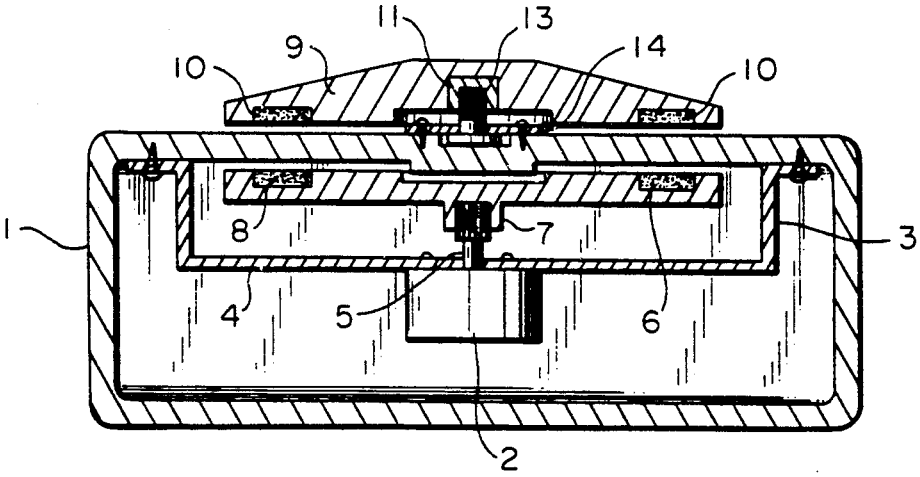
FIG. 1 is the vertical side elevation view of an embodiment of this invention.

Throughout the accompanying drawings, reference numeral (1) designates sealing container; (2), variable resistor; (3), bracket; (4), the concave on a bracket; (5), the shaft of a variable resistor; (6), arm member; (7), shaft-connecting shaft; (8)(10), magnets; (9), dial knob; (11), mounting hole; (12), guiding concave; (13), supporting shaft; (14), attaching member; (15), scale; (16), pin; symbol R, resistor; C, capacitor; Tr, transistor; T, transformer; P, active electrode; E, dispersive electrode; B, battery; and SW, power switch.

Now referring to FIG. 1, reference numeral (1) designates a sealing container with appropriate waterproofing, moistureproofing and impact resistance, which is usually made with a magnetically permeable material such as plastic, ceramic and rubber.

Reference numeral (2) designates a variable resistor, and its shape, electric resistance and power capacity are suitably chosen to meet to its use. Since the sealed variable resistor of this invention is high in adhesive strength between an arm member and a dial knob, variable resistors with a switch are favorably feasible in this invention.

Reference numeral (3) designates a bracket which is to fix the variable resistor (2) inside the sealing container (1). The bracket (3) is prepared by forming a concave (4) on a metal plate, for example, of aluminum, iron, brass or stainless steel, and flanging its opposite sides. The variable resistor (2) is attached approximately through the center of the concave (4) such that a shaft (5) of the variable resistor (2) projects inwardly the concave (4). The flanged parts of the bracket (3) are screwed onto the inside wall of the sealing container (1).

Reference numeral (6) designates an arm member, which is usually prepared by forming a magnetically permeable material such as plastic, ceramic and rubber into a circular plate such as true circular, elliptic or polygonal form. Approximately at the center of the lower side of the arm member (6) is disposed a shaft-connecting shaft (7) in which one end of the shaft (5) is tightly inserted. Magnets (8)(8) in tablet form are disposed on the arm member (6) and dial knob (9) concentrically about the connecting shaft (7) to make an angle of about 180°, preferably, in the range of about 170° to about 179°, more preferably, in the range of about 173° to about 175°.

The magnets (8)(8) are disposed such that they do not lie on the straight line across the connecting shaft (7). When in the below described case wherein the dial knob (9) is detachably supported about a shaft, the magnets (10)(10) are disposed on the straight line across the connecting shaft (7) and the magnets (10)(10) correspondingly disposed on the dial knob (9) come near to the magnets (8)(8) with the same polarity, the repulsion between the magnets (8)(10) hinders the access and attachment of the dial knob (9).

The dial knob (9) is usually prepared by forming a magnetically permeable material such as plastic, ceramic and rubber into a circular plate such as true circular, elliptic or polygonal form. At the center of its lower side is provided a mounting hole (11) with an engaging part such as roulette. The magnets (10)(10) in tablet form are disposed on a circular line with an appropriate radius in relative to the mounting hole (11). On the upper side of the dial knob (9) is provided a guiding concave (12) which helps users smoothly operate the dial knob (9). The guiding concave (12) is replaceable with a handle of an appropriate shape.

Reference numeral (13) designates a supporting shaft, which is made with a metal rod usually of brass or stainless steel. The top end of the supporting shaft (13) is flanged, while a roulette which fits on the mounting hole (11) is cut on the bottom end of the supporting shaft (13).

Reference numeral (14) designates an attaching member for the supporting shaft (13). The attaching member (14) is made with a metal piece, through which the supporting shaft (13) is rotatably fixed onto the upper external wall of the sealing container (1) while covering the flanged part of the supporting shaft (13). The attaching member (14) per se is usually made with a stainless metal such as stainless steel, and screwed onto the upper external wall of the sealing container (1).

The operation of the dial knob (9) becomes much smoother with an arrangement wherein a concentrical groove is concentrically provided about the mounting hole (11) on the lower side of the dial knob (9) while a corresponding boss is provided on the upper external wall of the sealing container (1), or with another arrangement wherein an appropriate bearing is disposed between the dial knob (9) and the upper external wall of the sealing container (1).

Figure 2:
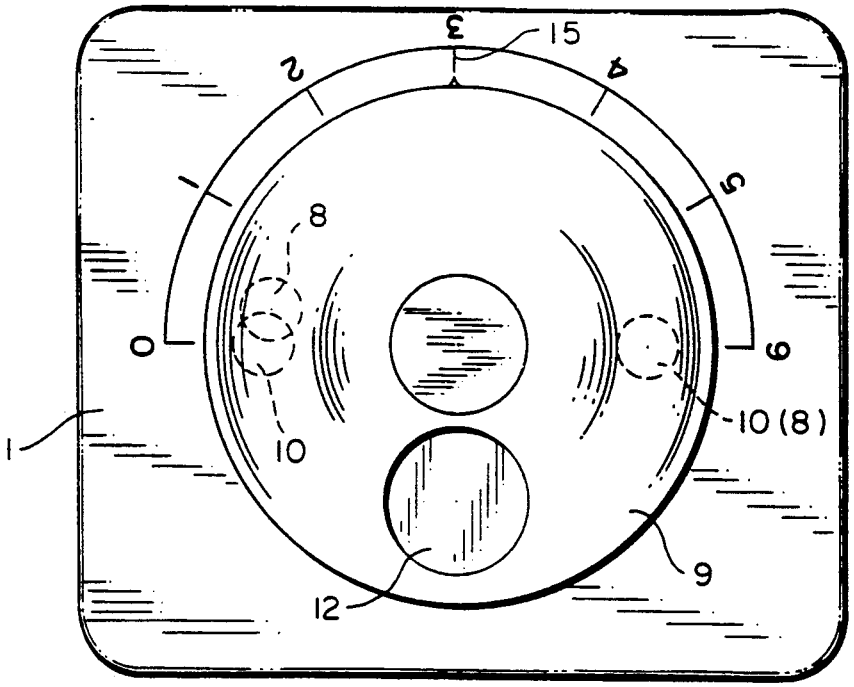
FIG. 2 is the plan view of the embodiment.

If necessary, a scale (15) can be conveniently provided on an appropriate part of either the dial knob (9) or the upper external wall of the sealing container (1) as shown in FIG. 2. This is very helpful to read the electric resistance of the variable resistor (1) and/or the ON/OFF position of switch, if any.

The following experiments were carried out in order to establish the merits of disposing a plurality of magnet pairs (8)(10) according to this invention.

Figure 3:
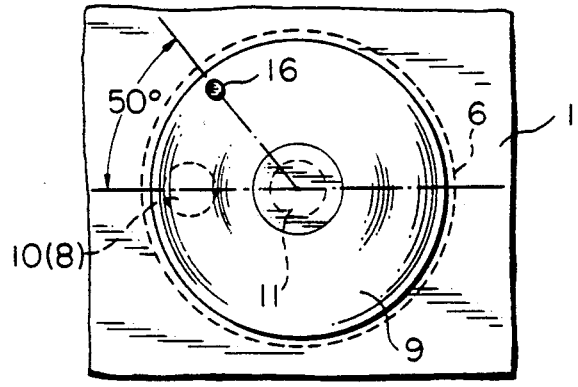
FIG. 3 is the top plain view showing an arrangement wherein one magnet pair is attached to an arm member and a dial.
Figure 4:
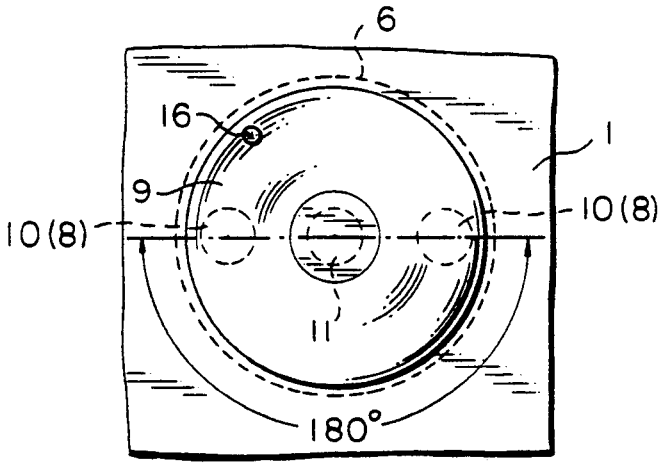
FIG. 4 is the top plain view showing another arrangement wherein two magnet pairs are attached to an arm member and a dial knob.

FIG. 3 shows one arrangement (referred to as "Magnet 1" hereinafter) wherein one pair of magnets (8)(10) in tablet form are attached on an arm member (6) and a dial knob (9); FIG. 4, another arrangement (referred to as "Magnet 2" hereinafter) wherein two pairs of magnets (8)(10) of the same shape and size are attached on an arm member (6) and a dial knob (9) of the same shape, size and material to make an angle of about 180° concentrically about a mounting hole (11); and FIG. 5, still another arrangement (referred to as "Magnet 3" hereinafter) wherein three pairs of magnets (8)(10) of the same shape and size are attached on an arm member (6) and a dial (9) of the same shape, size and material to make an angle of about 120° concentrically about a mounting hole (11). Each arrangement was tested for its maximum adhesive strength, slippage on starting and during operation as a criterion of reliability, and backlash as a criterion of operability.

Each arrangement was further tested for its connecting strength as a criterion of impact resistance.

These characteristics were determined by the following methods:

(i) Maximum adhesive strength

Figure 5:
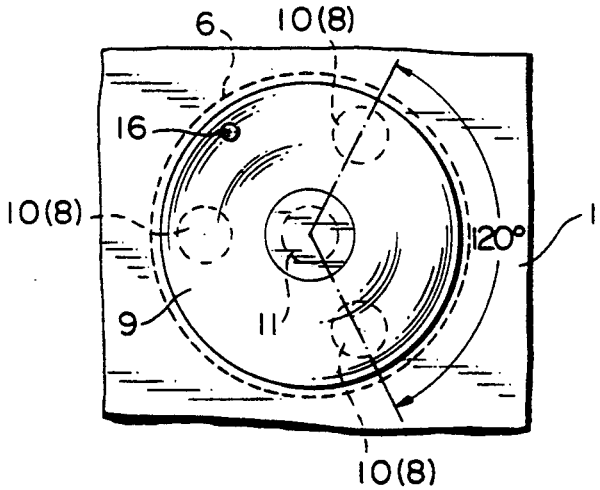
FIG. 5 is the top plain view showing still another arrangement wherein three magnet pairs are attached to an arm member and a dial knob.

As shown in FIGS. 3–5, a pin (16) was concentrically set on the upper side of the dial knob (9). The pin (16) was applied with a mechanical force through a spring balance while keeping the arm member (6) immovable. Under these conditions, the force (gf) to put apart the magnets (8)(10) was determined.

(ii) Slippage on starting

Slippage (°) was determined with the circumferential scale by slowly moving the dial knob (9) till the arm member (6) started to move.

(iii) Slippage during rotation

Slippage (°) of the arm member (6) was determined when the dial knob (9) is turned by about 120°.

(iv) Connecting strength

Impact was applied to the pin (16) through a compressed spring balance while keeping the arm member (6) immovable. Under these conditions, the magnitude (gf) of the impact to disconnect the magnets (8)(10) was determined.

These three arrangements were evaluated by grading the obtained scores into three ranks, i.e. "superior", "passable" and "inferior".

The results were as shown in Table.

TABLE

| | Magnet 1 | Magnet 2 | Magnet 3 |
|---|---|---|---|
| Maximum adhesive strength | 116 gf | 197 gf | 403 gf |
| Evaluation | Inferior | Passable | Superior |
| Slippage on starting | 11.8° | 2° | 2° |
| Evaluation | Inferior | Superior | Superior |
| Slippage during operation | 10° | 5° | 3° |
| Evaluation | Inferior | Passable | Superior |
| Backlash | Inferior | Superior | Passable |
| Connecting strength | 178 gf | 404 gf | 598 gf |
| Evaluation | Inferior | Superior | Superior |
| Judgement | Control | This invention | This invention |

As evident from the results in Table, I found that "Magnet 1" was poor in reliability because of low adhesive strength, large slippage on starting and during operation, and large backlash although it attained a relatively smooth operation.

I also found that "Magnet 2" was highest in reliability and least in slippage on starting and backlash because of reasonable structure and mechanical balance. Since "Magnet 3" was highest in adhesion strength, it was highly reliable and caused no substantial backlash and slippage even on starting and during operation.

Since both "Magnet 2" and "Magnet 3" were higher in connecting strength, the magnets hardly disconnect even when applied with impact, and, if disconnected, are easily returnable to the normal arrangement.

When all these data are put together, "Magnet 2", "Magnet 3" and "Magnet 1" can be graded in this order. I also found that "Magnet 2" was far superior to "Magnet 3".

As a consequence of the foregoing arrangement of this invention, it is favorably usable in electrotherapeutic devices directed to use in bathroom and bathtub by enclosing, for example, a low-frequency oscillator and a battery, in the sealing container, and connecting through leads (not shown) the output of the oscillator with appropriate electrodes which are disposed outwardly the sealing container (1).

Figure 6:
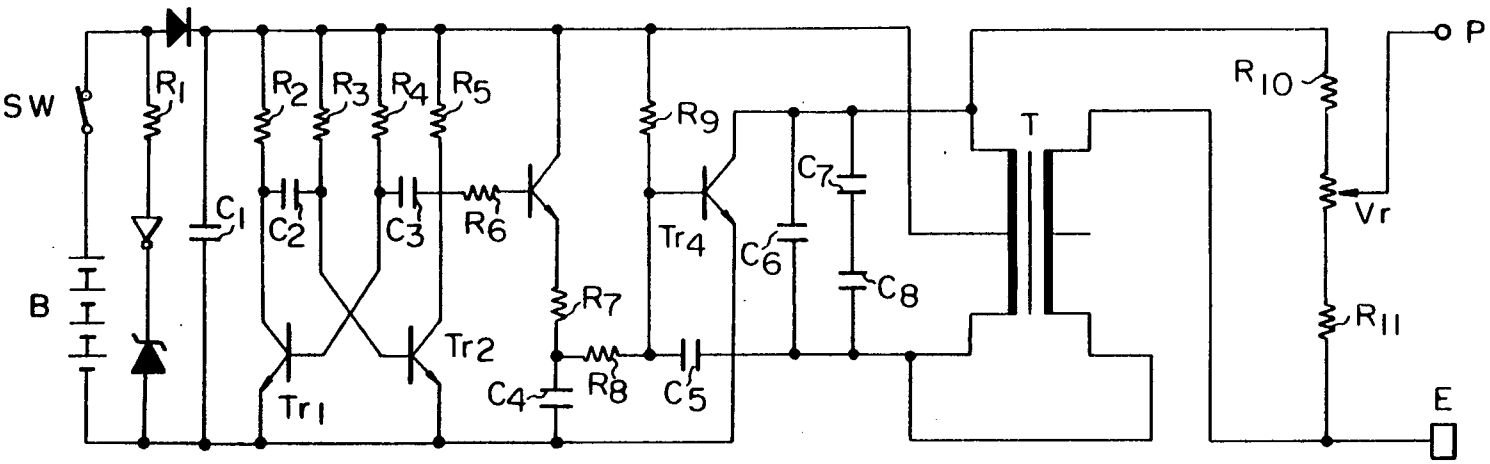
FIG. 6 is the electric circuit of an electrotherapeutic device using a sealed variable resistor of this invention.

FIG. 6 shows the electric circuit of an electrotherapeutic device which is favorably feasible in such a use.

Now explaining the operation of this circuit, a multivibrator comprising transistors $Tr_1$ and $Tr_2$ generates and supplies a square wave, for example, with a pulse width of about 0.1 second to about 10 seconds, pulse interval of about 0.1 second to about 10 seconds, to an emitter follower which comprises a transistor $Tr_3$ and has an appropriate time constant. Thus, a gradually increasing voltage is obtained.

By supplying the voltage to the base of a transistor $Tr_4$ in a blocking oscillator which generates a diphasic action potential waveform, a diphasic action potential with a pulse interval varying a prescribed frequency is supplied across a pair of electrodes P and E because the oscillation frequency of such a blocking oscillator varies dependently on the magnitude of base biasing voltage.

The diphasic action potentials feasible in this invention are those which have a frequency of about 1 hertz to about 200 hertz and a ratio of positive voltage component to negative voltage component in each of repeating pulsatile waves in the range of about 0.1:1 to about 0.5:1, preferably, in the range of about 0.2:1 to about 0.3:1, as well as having a duration for the negative voltage component in the range of about 0.001 second to about 0.01 second, preferably, about 0.002 seconds to about 0.005 seconds, and also a duration for the positive voltage component which lasts about 1.1 fold to about 2.0 folds, preferably, about 1.4 folds to about 1.6 folds of the duration for the negative voltage component.

Comfortable electrotherapy free of side effects such as pain, redness, burn and unpleasantness is attainable by approximately equalizing the energies in forward and reverse directions in each of repeating pulsatile waves, or decreasing the energy in forward direction, preferably, by setting the ratio of the energy in forward direction to that in reverse direction in the range of about 0.1:1 to about 1:1, more preferably, in the range of about 0.2:1 to about 0.6:1.

When in use, the power switch SW is first turned on, then the dispersive electrode E is put on a normal dermal site or placed in bathtub while turning down the variable resistor VR. Thereafter, the active electrode P is brought near to the affected site, and the variable resistor VR is gradually turned up to give a prescribed stimulation. Thus, the diphasic action potential is applied to the affected site.

As described above, since in this invention at least two magnet pairs are disposed to an arm member and a dial knob which are formed into a circular plate, the arm member and dial knob exert a high adhesive strength and this decreases or even eliminates slippage during operation and backlash.

Furthermore, since in this invention at least two magnet pairs are attached apart from each other, the dial knob is smoothly operable even with a small power.

This invention is therefore favorably usable for variable resistor directed to various electrical devices including electrotherapeutic devices which may be exposed to moisture.

I claim:

1. A device to effect low-frequency electrotherapy in a humid environment, comprising:

an active electrode;

a dispersive electrode;

a low-frequency oscillator having output terminals connected with said electrodes;

a battery connected with said low-frequency oscillator for its energization;

a variable resistor with a shaft, said variable resistor being connected between the output terminals of said oscillator and electrodes;

a sealing container in which said low-frequency oscillator, battery and variable resistor are enclosed;

a dial knob in a circular plate form, said dial knob being rotatably provided outside said container;

a first pair of magnets, both magnets being separately attached to said dial knob;

an arm member in a circular plate form, said arm member being rotatably provided inside said container and centrally attached to the shaft of said variable resistor; and a second pair of magnets, both magnets being separately attached to said arm member such that said arm member moves in association with the rotation of said dial knob.

2. The device of claim 1, wherein said first and second magnet pairs are concentrically attached such that they make an angle of about 180° relative to the shaft of said variable resistor.

3. The device of claim 1, wherein said variable resistor includes a switch.

* * * * *